US006536421B1

(12) United States Patent
Jenkins

(10) Patent No.: US 6,536,421 B1
(45) Date of Patent: Mar. 25, 2003

(54) ARCHERY BOW

(75) Inventor: David A. Jenkins, Gainesville, FL (US)

(73) Assignee: University of Florida, Gainesville, FL (US)

( * ) Notice: Subject to any disclaimer, the term of this patent is extended or adjusted under 35 U.S.C. 154(b) by 0 days.

(21) Appl. No.: 09/724,331

(22) Filed: Nov. 28, 2000

(51) Int. Cl.[7] ..... F41B 5/00
(52) U.S. Cl. ..... 124/23.1
(58) Field of Search ..... 124/23.1, 25.6, 124/86, 88

(56) References Cited

U.S. PATENT DOCUMENTS

| | | | | | |
|---|---|---|---|---|---|
| 126,734 | A | * | 5/1872 | Morton | |
| D77,892 | S | * | 3/1929 | Cowdery | |
| 1,810,335 | A | * | 6/1931 | Barnhart | |
| 1,960,477 | A | * | 5/1934 | Cowdery | |
| 2,957,470 | A | * | 10/1960 | Barna | |
| 3,674,001 | A | | 7/1972 | Hitt | |
| 4,041,927 | A | | 8/1977 | Van House | 124/61 |
| 4,088,111 | A | | 5/1978 | Li | |
| 4,122,821 | A | | 10/1978 | Mamo | |
| 4,207,859 | A | | 6/1980 | Scholten | |
| 4,244,345 | A | | 1/1981 | Simo et al. | |
| 4,644,928 | A | | 2/1987 | Studanski | |
| 4,644,929 | A | * | 2/1987 | Peck | |
| 5,454,361 | A | | 10/1995 | Bronnert | 124/23.1 |
| 5,722,380 | A | * | 3/1998 | Land et al. | |
| 6,024,076 | A | * | 2/2000 | Laborde et al. | 124/23.1 |
| 6,105,564 | A | | 8/2000 | Suppan | 124/23.1 |

* cited by examiner

*Primary Examiner*—John A. Ricci
(74) *Attorney, Agent, or Firm*—Saliwanchik, Lloyd & Saliwanchik

(57) ABSTRACT

An archery bow with elastic limbs extending outwardly from the handle, constructed so that portions of these limbs twist around the limb axis to a lower moment of inertia configuration during the draw, storing additional torsional strain energy and also altering the force-draw characteristic of the bow in a favorable way.

31 Claims, 8 Drawing Sheets

ARCHERY BOW

BACKGROUND OF THE INVENTION

1. Field of the Invention

The present invention relates to an improved archery bow and more specifically to a bow which provides for additional energy to be stored in, the limbs during the draw, making it more comfortable for the archer and capable of launching arrows at higher velocity.

2. Description of Related Art

Conventional recurve bows and longbows have limbs with flattened cross sections which experience bending around only a single axis as the bow is drawn. Their force-draw characteristics are approximately linear, with most bows exhibiting a gentle inverted "S" shaped curve with an ever increasing slope, or "stacking" as fill draw is approached. Upon release of the string, the arrow experiences an initial large force which rapidly drops off. The arrow shaft responds by bending and going through a series of oscillations as it leaves the bow. The complex dynamics of the arrow makes for an inefficient transfer of energy to the arrow, resulting in relatively slow flight speeds.

The compound bow makes a drastic alteration of the force-draw curve such that the draw force at full draw is lower than the peak draw force earlier in the draw. The action upon release of the string is a more appropriate and gradual delivery of force to the arrow, with the result that the arrow bends less and flies truer and faster, and the efficiency of energy delivery to the arrow is much improved over the conventional bow. Compound bows achieve their altered force-draw curves at the expense of much additional complexity and weight, and do not resemble the traditional archery bows.

Attempts have been made to construct bows with more traditional appearance having some of the advantages of compound bows, for example, U.S. Pat. No. 4,088,111 (Li) and U.S. Pat. No. 4,122,821 (Mamo) both attempt to store additional energy or modify the force-draw curves of the bows using a controlled deformation of the cross section of the limbs during the draw. The Li patent describes that additional energy can be stored during the draw by using the lateral deformation of elements of the cross section of the limb. The designs are effectively limited to lateral movements only, even going so far as including a hinge element to isolate that particular motion and eliminate other modes such as twisting. Li discloses storing energy by laterally stretching an elastic membrane and also by compressing trapped gas. The Li designs never made an impact on the traditional archery bow field as they are unwieldy.

Mamo discloses modifying the force-draw curve by using laterally curved rectangular cross section limbs which tend to increase their radius of curvature or flatten as the bow is drawn. In practice, if such cross sections are thick enough to provide sufficient bending stiffness for the bow, then they are too thick to flatten appreciably without exceeding the strength of the material from which they are made.

Both the Mamo and the Li patents indicate that their bows can have a draw force at full draw that is lower than the peak draw force earlier in the draw. However, the resulting negative draw force slope will always, result in an unstable bow, whereby one of the limbs "breaks over" before the other during the draw. As with the compound bows, this instability can be overcome by mechanically coupling the limbs to synchronize their movements. Unfortunately, the resulting bow would have an appearance similar to that of a compound bow.

Further attempts to improve the performance of conventional bows have been tried by incorporating additional elements to the construction of the bow. Such attempts include extra limbs or other separate energy storage elements incorporated into the bow. These approaches, of course, represent steps away from the elegant simplicity of the traditional bow and are, in reality, alternate forms of compound bows. Examples of bows with additional elements added include: U.S. Pat. No. 5,454,361 (Bronnert); U.S. Pat. No. 3,674,001 (Hitt); U.S. Pat. No. 4,244,345 (Simo); U.S. Pat. No. 4,644,928 (Studanski); U.S. Pat. No. 4,041,927 (Van House); U.S. Pat. No. 4,207,859 (Scholten).

Bronnert describes a "sequential bow" with a second bending member in contact with the main limb. Hitt describes adding an auxiliary limb to modify the behavior of the bow. Simo et al. describes a bow with a torsion bar element separate from the limbs that is twisted by contact with a camming device connected to the limbs, which are designed to be non-bending and simply rotate around a pivot at the handle. The Simo system, while it does store energy in torsion, results in a slow and inefficient bow because of the large movements required of the limbs. Van House, similar to Simo, involves the addition of a compression spring, which is also connected to the main limbs through a mechanical linkage. Studanski proposes using a secondary buckling member that spans from limb to limb, while Scholten provides buckling members mechanically linked to rotating main limbs.

While the advantages of altering the force-draw curve are known in the art, the majority approach the challenge by adding extra parts to the bow. Additionally, a few have thought of ways to achieve the wanted alteration by using some deformation of the cross section of the limb during the draw. However, none have recognized the substantial advantages of storing energy in the limbs by torsion or rotation of parts of the limb.

BRIEF SUMMARY OF THE INVENTION

The present invention is a bow having a pair of limbs, where a portion of each limb is divided into two parallel sections. The parallel sections are initially twisted away from the flat orientation in a symmetric manner, so that the sections are twisted into a high-moment-of-inertia configuration. As the bow is drawn, the sections are increasingly twisted toward the flat, low moment-of-inertia configuration by the radial stresses that develop in the limb members during bending. In conventional bows, energy is stored in the limbs during the draw in the form of elastic strain energy due to bending. In the present invention, the energy due to bending is stored as usual, but the twisting of the parallel sections causes additional energy to be stored in the form of torsional elastic strain energy. This torsional elastic strain energy due to twisting can be made to develop mainly during the early and middle parts of the draw. Before each section twists to the flat, low moment of inertia configuration, those sections of the limb behave as stiffer, high moment of inertia sections. The bow thus behaves as a high draw force bow early in the draw and as a low draw force bow late in the draw after all sections have become flattened. The difference in energy under the force-draw curves of the invention bow and an equivalent flat-limbed bow is directly attributable to the torsional strain energy stored.

It is an objective of the present invention to provide an archery bow having limbs which store energy more abundantly and efficiently, thus resulting in a faster and truer arrow flight.

It is a further objective of the present invention to provide an archery bow that has the same stored energy as a conventional bow with a reduced full draw weight.

These and other objects, features and advantages of the present invention will be more readily understood with reference to the following detailed description, read in conjunction with the accompanying drawing figures.

All patents, patent applications and publications referred to or cited herein are incorporated by reference in their entirety to the extent they are not inconsistent with the explicit teachings of this specification, including; U.S. Pat. No. 4,088,111 (Li), U.S. Pat. No. 4,122,821 (Mamo), U.S. Pat. No. 5,454,361 (Bronnert), U.S. Pat. No. 3,674,001 (Hitt), U.S. Pat. No. 4,244,345 (Simo), U.S. Pat. No. 4,644,928 (Studanski), U.S. Pat. No. 4,041,927 (Van House), and U.S. Pat. No. 4,207,859 (Scholten).

DETAILED DISCLOSURE OF THE INVENTION

Figure 1:
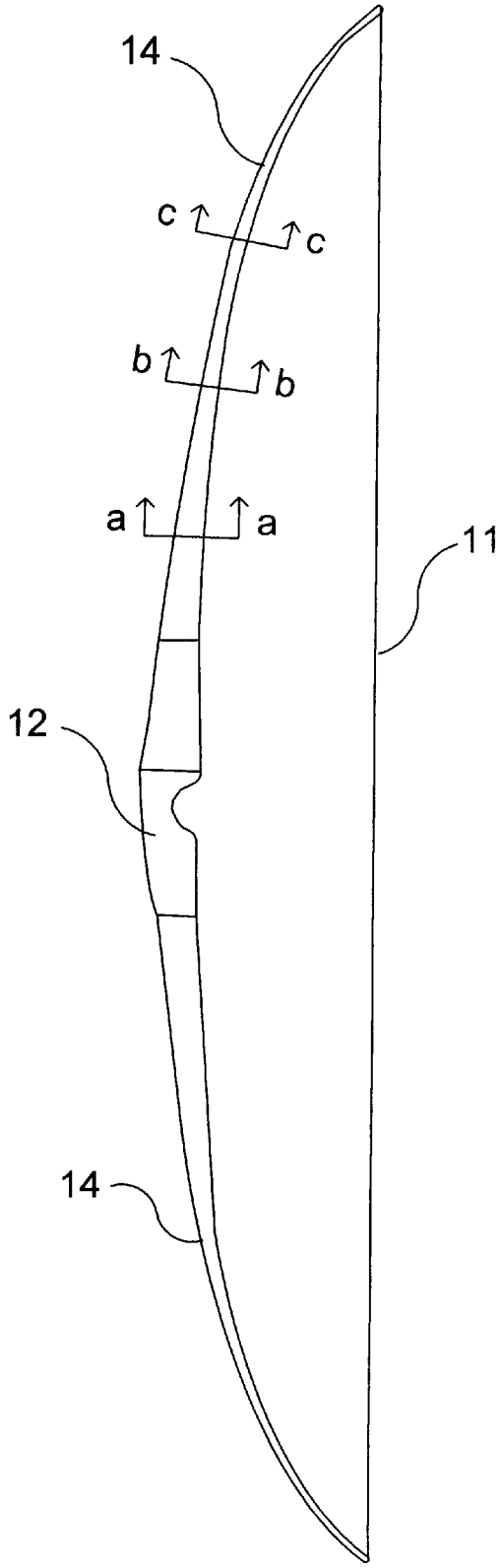
FIG. 1 shows a side view of the archery bow of the present invention.

Referring to FIG. 1, as in prior art bows, the archery bow 10 of the present invention includes a central grip portion 12, with a pair of outwardly extending limbs 14. When the bow 10 is drawn, with the bow string 11, the pair of outwardly extending limbs 14 are drawn together.

Figure 2:
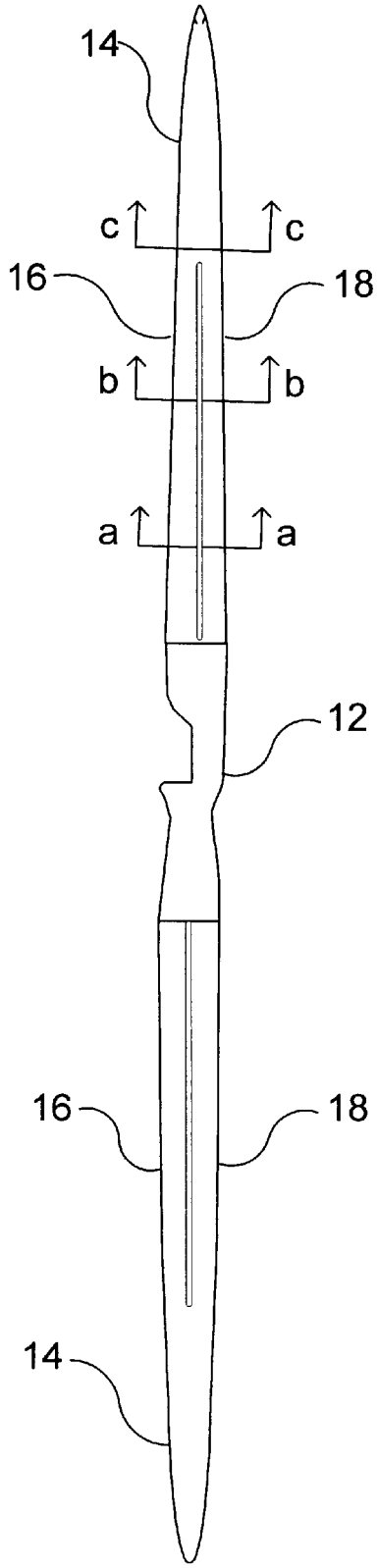
FIG. 2 shows a rear view of the archery bow of the present invention.
Figure 4:
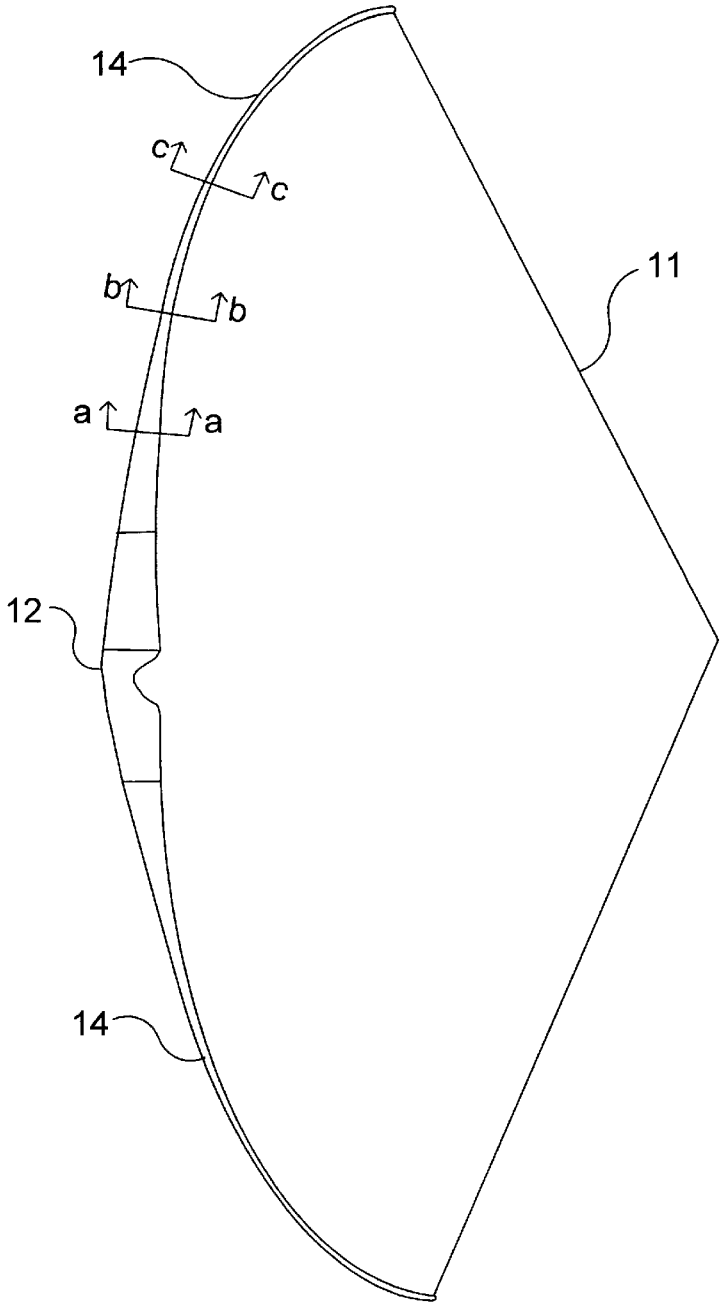
FIG. 4 shows a side view of the archery bow of the present invention in a drawn position.
Figure 3C:
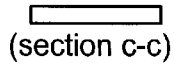
FIGS. 3*a*–3*c* shows the cross sectional configuration of sections a—a, b—b, and c—c in a non-drawn position.
Figure 3B:
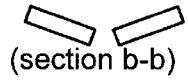
Figure 3A:
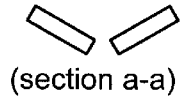
Figure 5C:
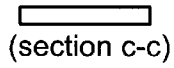
FIGS. 5*a*–5*c* shows the cross sectional configuration of sections a—a, b—b, and c—c in a drawn position.
Figure 5B:
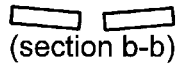
Figure 5A:
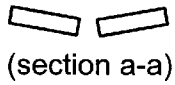

In an embodiment of the present invention, as shown in FIG. 2, a portion of each limbs 14 are divided into two parallel sections 16 and 18. The parallel sections 16 and 18 are axisymmetric about the longitudinal axial center line of the bow 10. As shown in FIGS. 3*a*–3*c*, the parallel sections 16 and 18 are initially twisted away from the flat orientation in a symmetric manner inclining from opposite direction towards a common center line, so that the parallel sections 16 and 18 at cross sections a—a and b—b are twisted into a high-moment-of-inertia configuration. The orientation of the parallel sections 16 and 18 is substantially similar to a syncline or anticline configuration. At cross section c—c, the limbs 14 are not twisted or divided and simply remain flat, in a low moment of inertia configuration, as in a conventional bow. As the bow 10 is drawn, as shown in FIGS. 4 and 5*a*–5*c*, the parallel sections 16 and 18 at cross sections a—a and b—b are increasingly twisted toward the flat, low moment-of-inertia configuration, by the radial stresses that develop in limbs 14 during bending. The limbs 14 at cross sections c—c remain in the original configuration. In conventional bows, energy is stored in the limbs during the draw in the form of elastic strain energy due to bending. In the present invention bow 10, the energy due to bending is stored as usual, but the twisting of the parallel sections 16 and 18 causes additional energy to be stored in the form of torsional elastic strain energy. This torsional elastic strain energy due to twisting can be made to develop mainly during the early and middle parts of the draw. Before the parallel sections 16 and 18 twists to the flat, low moment of inertia configuration, those sections 16 and 18 of the limbs 14 behave as stiffer, high moment of inertia sections. The result is the bow 10 having a rate of increase of the draw force which decreases as the bow is drawn. Whereby the bow behaves as a high draw force bow early in the draw and as a low draw force bow late in the draw, after the parallel sections 16 and 18 have become flattened. The difference in energy under the force-draw curves of the present invention bow 10 and an equivalent flat-limbed bow is directly attributable to the torsional strain energy stored.

Figure 6:
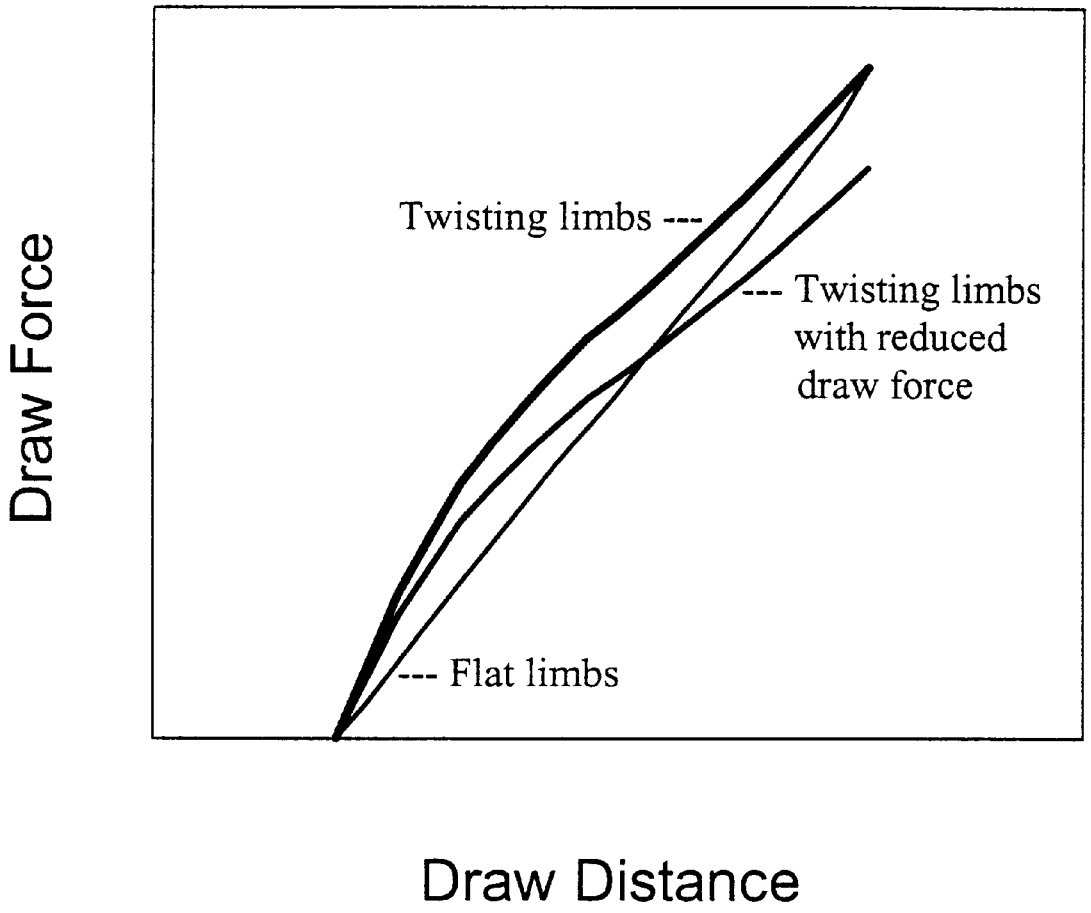
FIG. 6 shows a graph comparing the stored energy of a conventional bow and the bow of the present invention.
Figure 7:
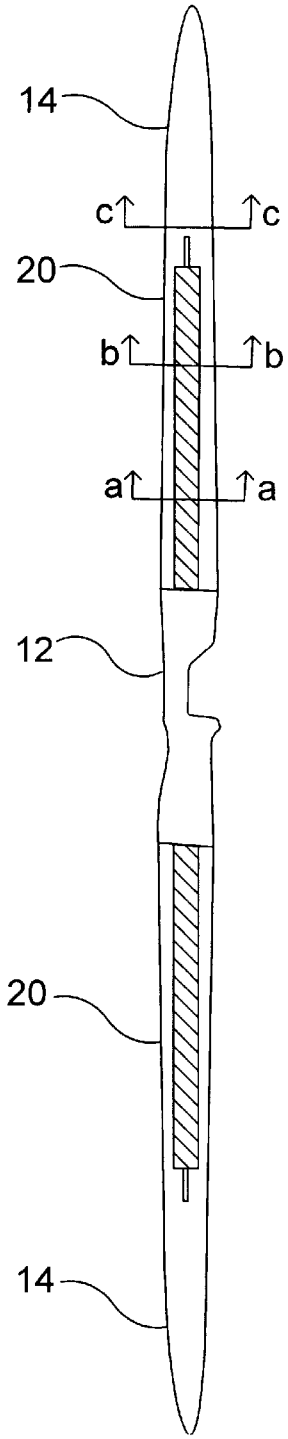
FIG. 7 shows a front view of the archery bow of the present invention including flexural elements.
Figure 8C:
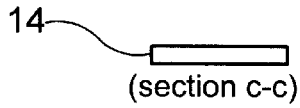
FIGS. 8*a*–8*c* shows the cross sectional configuration of sections a—a, b—b, and c—c, including flexural elements, in a non-drawn position.
Figure 8B:
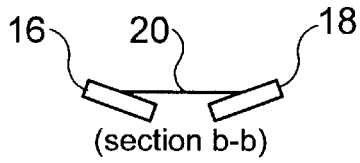
Figure 8A:
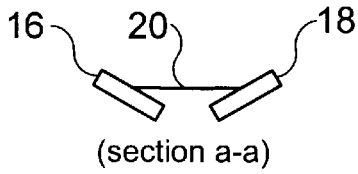

In FIG. 6, force-draw distance measurements are presented for the bow 10 of the present invention. The upper solid line is the trace for the bow with actively twisting limbs 14. The lower line is for the same bow with the limbs held in the flattened shape using several small clamps. The difference in stored energy is clearly seen as the area difference between the two curves. The twisting limbs 14 show the desirable increases in draw force during the early part of the draw. Also shown in FIG. 6 is a force-draw curve for a twisting limb bow with only 85% of the full draw force of the other two bows. The potential energy stored under this curve is approximately equal to that of the flat limbed bow with the higher full draw force.

In a further embodiment, because the strain energy of torsion is proportional to both the magnitude of the torsion and the angle of twist, the effect of the parallel sections 16 and 18 can be enhanced by adding an additional resistance to the torsional deformations. Therefore, increasing the torsional stiffness will improve the strain energy storage, provided that the twist angles are not excessively limited.

Figure 9C:
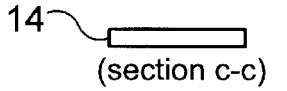
FIGS. 9*a*–9*c* shows the cross sectional configuration of sections a—a, b—b, and c—c, including flexural elements, in a drawn position.
Figure 9B:
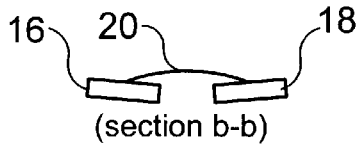
Figure 9A:
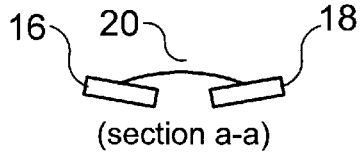

In an embodiment, as shown in FIGS. 7 and 8*a*–8*c*, flexural elements 20, connecting the parallel sections 16 and 18, are added to the front of the limbs 14. The flexural elements 20 increase the torsional stiffness of the parallel sections 16 and 18, make twisting more difficult. As shown in FIGS. 9*a*–9*c*, the radii of curvature of the flexural elements 20 decrease as the bow 10 is drawn.

Figure 13C:
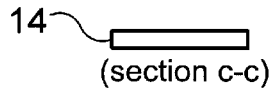
FIGS. 13*a*–13*c* shows the cross sectional configuration of sections a—a, b—b, and c—c, including flexural elements, in a drawn position.
Figure 13B:
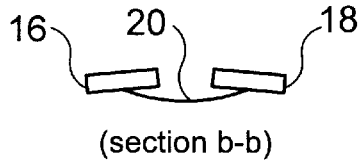
Figure 13A:
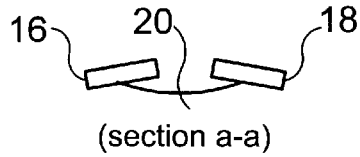
Figure 14:
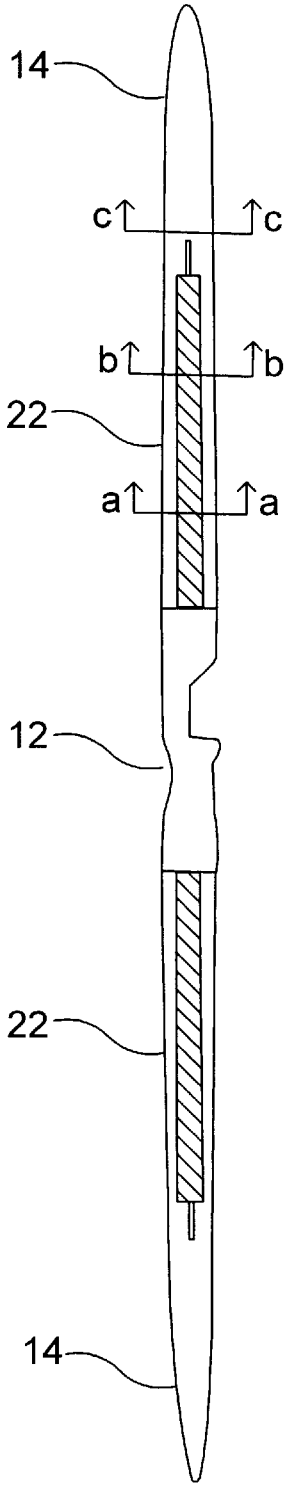
FIG. 14 shows a front view of the archery bow of the present invention including lateral tension elements.
Figure 15C:
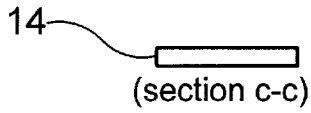
FIGS. 15*a*–15*c* shows the cross sectional configuration of sections a—a, b—b, and c—c, including lateral tension elements, in a non-drawn position.
Figure 15B:
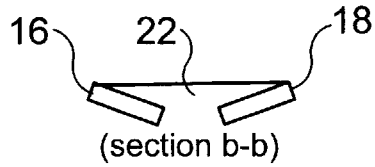
Figure 15A:
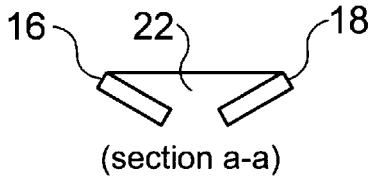
Figure 16C:
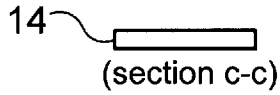
FIGS. 16*a*–16*c* shows the cross sectional configuration of sections a—a, b—b, and c—c, including lateral tension elements, in a drawn position.
Figure 16B:
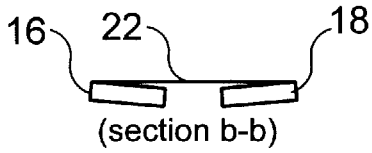
Figure 16A:
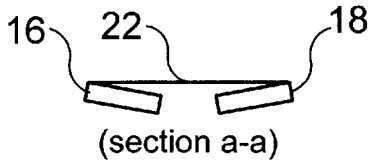
Figure 17:
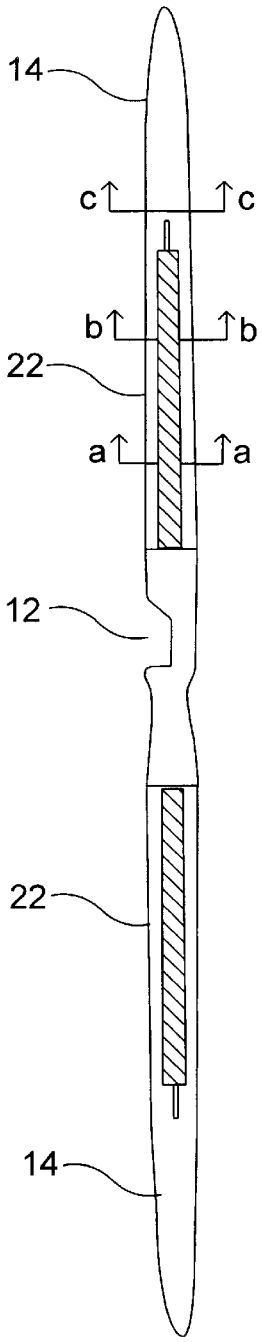
FIG. 17 shows a rear view of the archery bow of the present invention including flexural elements.
Figure 18C:
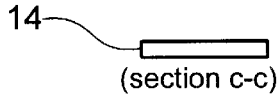
FIGS. 18*a*–18*c* shows the cross sectional configuration of sections a—a, b—b, and c—c, including lateral tension elements, in a non-drawn position.
Figure 18B:
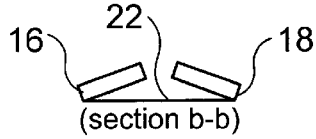
Figure 18A:
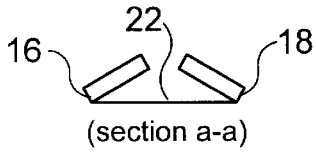
Figure 19C:
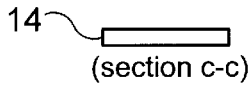
FIGS. 19*a*–19*c* shows the cross sectional configuration of sections a—a, b—b, and c—c, including lateral tension elements, in a drawn position.
Figure 19B:
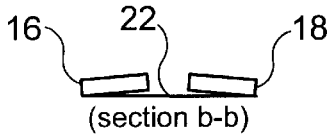
Figure 19A:
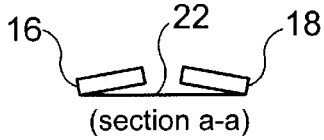

In an alternative embodiment, as shown in FIGS. 11 and 12*a*–12*c*, flexural elements 20, connecting the parallel sections 16 and 18, are added to the rear of the limbs 14. The flexural elements 20 increase the torsional stiffness of the parallel sections 16 and 18, make twisting more difficult. As shown in FIGS. 13*a*–13*c*the radii of curvature of the flexural elements 20 decrease as the bow 10 is drawn.

In a further embodiment, as shown in FIGS. 14, 15*a*–15*c*and 16*a*–16*c* lateral tension elements 22, connecting the parallel sections 16 and 18, are added to the rear of the limbs 14. The lateral tension elements 22 increase the torsional stiffness of the parallel sections 16 and 18, make twisting more difficult.

In a further embodiment, as shown in FIGS. 17, 18*a*–18*c*, and 19*a*–19*c* lateral tension elements 22, connecting the parallel sections 16 and 18, are added to the front of the limbs 14. The lateral tension elements 22 increase the torsional stiffness of the parallel sections 16 and 18, make twisting more difficult.

Figure 20C:
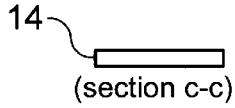
FIGS. 20*a*–20*c* shows the cross sectional configuration of sections a—a, b—b, and c—c, including lateral compression elements.
Figure 20B:
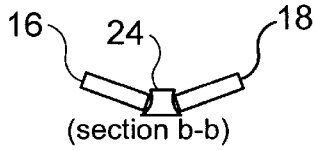
Figure 20A:
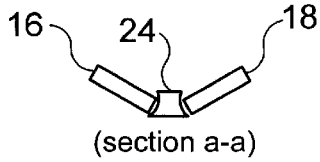

In an alternative embodiment, as shown in FIGS. 20*a*–20*c*, lateral compressive elements 24 are added in between the parallel sections 16 and 18. The lateral compressive elements 24 increase the torsional stiffness of the parallel sections 16 and 18, make twisting more difficult.

Figure 10:
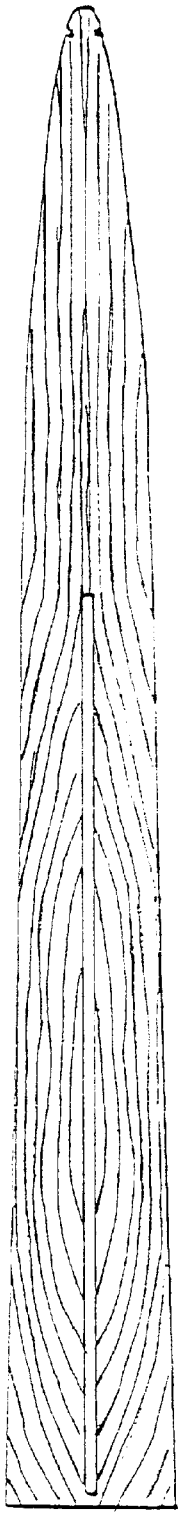
FIG. 10 shows a material configuration of the present invention.
Figure 11:
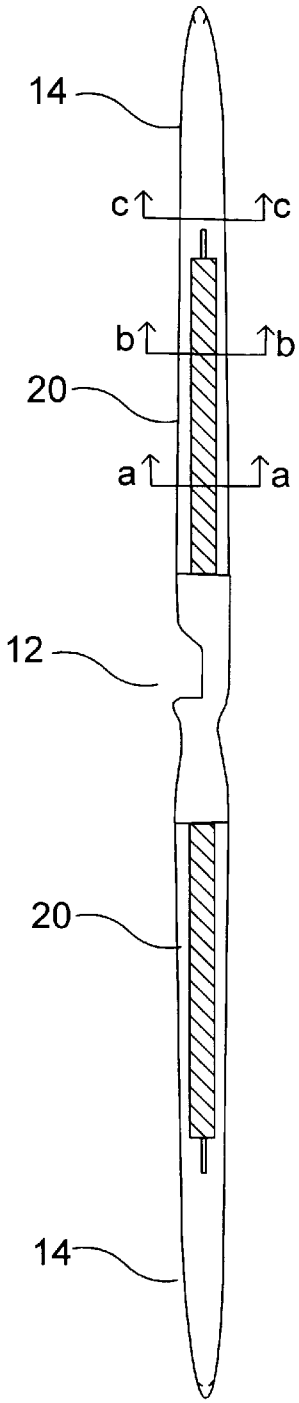
FIG. 11 shows a rear view of the archery bow of the present invention including flexural elements.
Figure 12C:
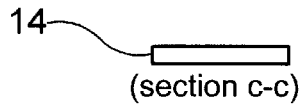
FIGS. 12*a*–12*c* shows the cross sectional configuration of sections a—a, b—b, and c—c, including flexural elements, in a non-drawn position.
Figure 12B:
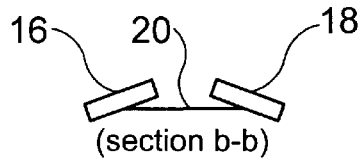
Figure 12A:
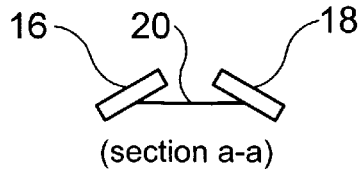

In an embodiment, for limbs 14 constructed utilizing fibrous composite materials, from which bow limbs are often made, the layout of the fibers should be done with the principal stress trajectories at full draw in mind. FIG. 10, demonstrates an advantageous layout for the front side of a limb 14, after taking into account the principal tensile stresses resulting from the combination of bending stresses and shear stresses due to torsion. With this arrangement, the intrinsic strength of the fibers and matrix can be best utilized by aligning the fibers with the principal stress directions. The angle of the fibers changes because the twisting portion of the limb 14 is fixed at both ends and the shear strains due to torsion reverse as one moves from the handle end out toward the tip of the limb. On the rearward side of the limb 14, most of the fibers will be laid out along the principal compressive stress trajectories, with additional fibers provided perpendicular to these, in the direction of the principal tensile stresses, which will be smaller than the compressive stresses.

It should be understood that the examples and embodiments described herein are for illustrative purposes only and that various modifications or changes in light thereof will be suggested to persons skilled in the art and are to be included within the spirit and purview of this application and the scope of the appended claims.

References

Hitt, Otis H., U.S. Pat. No. 3,674,001, issued Jul. 4, 1972.

Van House, Robert, U.S. Pat. No. 4,041,927, issued Aug. 16, 1997.

Li, Yao T., U.S. Pat. No. 4,088,111, issued May 9, 1978.

Mamo, Anthony C., U.S. Pat. No. 4,122,821, issued Oct. 31, 1978.

Scholten, Gerard, U.S. Pat. No. 4,207,859; issue Jun. 17, 1980.

Simo, Mineslav A., U.S. Pat. No. 4,244,345; issued Jan. 13, 1981.

Studanski, Richard, U.S. Pat. No. 4,644,928; issued Feb. 24, 1987.

Bronnert, Herve X., U.S. Pat. No. 5,454,361; issued Oct. 3, 1995.

Suppan, Herbert. U.S. Pat. No. 6,105,2000; issued Aug. 20, 2000.

What is claimed is:

1. An archery bow comprising a pair of longitudinal extending limbs and a pair of divided sections, said divided sections comprising a pair of substantially axisymmetric, parallel elements, said parallel elements being non-planar, wherein said divided sections longitudinally divide a portion of said limbs.

2. An archery bow according to claim 1, wherein said stiffness of said parallel elements is a function of the bending of the said limbs, so that the rate of increase of the draw force decreases as said bow is drawn.

3. An archery bow according to claim 1, wherein said parallel elements incline from opposite direction towards a longitudinal center line.

4. An archery bow according to claim 1, further comprising a set of stiffening elements affixed to said, parallel elements.

5. An archery bow according to claim 4, wherein said stiffening elements are a set of flexural elements.

6. An archery bow according to claim 5, wherein said flexural elements are on the front of said limbs.

7. An archery bow according to claim 5 wherein said flexural elements are on the rear of said limbs.

8. An archery bow according to claim 4, wherein said stiffening elements are a set of lateral tension elements.

9. An archery bow according to claim 8, wherein said lateral tension elements are on the front of said limbs.

10. An archery bow according to claim 8, wherein said lateral tension elements are on the rear of said limbs.

11. An archery bow according to claim 4, wherein said stiffening elements are a set of lateral compressive elements.

12. An archery bow according to claim 1, further comprising a central grip interposed between and secured to said limbs.

13. An archery bow comprising a pair of longitudinally extending limbs; wherein said limbs comprise a means for storing energy by torsional and rotational deformation.

14. An archery bow according to claim 13, further comprising a means for increasing the torsional stiffness of said means for storing energy.

15. An archery bow comprising;

a) a pair of longitudinally extending limbs; and b) a bowstring attached to the tips of said limbs, wherein a portion of said limbs comprise a limb structure which stores energy, when said bowstring is drawn, by torsional and rotational deformation.

16. An archery bow according to claim 15, wherein a portion of said limb structure comprise a pair of longitudinally divided sections.

17. An archery bow according to claim 16, wherein said divided sections comprise a pair of substantially axisymmetric, parallel elements, wherein said parallel elements are non-planar.

18. An archery bow according to claim 17, wherein said limb structure further comprises a set of stiffening elements affixed to said parallel elements.

19. A limb for an archery bow, said limb comprising a divided section, said divided section comprising a pair of substantially axisymmetric, parallel elements, said parallel elements being non-planar, wherein said divided sections longitudinally divide a portion of said limb.

20. The limb according to claim 19, wherein said stiffness of said parallel elements is a function of the bending of said limb, so that the rate of increase of the draw force decreases as the bow is drawn.

21. The limb according to claim 19, wherein said parallel elements incline from opposite direction towards a longitudinal center line.

22. The limb according to claim 19, further comprising a set of stiffening elements affixed to said parallel elements.

23. The limb according to claim 22, wherein said stiffening elements are a set of flexural elements.

24. The limb according to claim 23, wherein said flexural elements are on the front of said limb.

25. The limb according to claim 23 wherein said flexural elements are on the rear of said limb.

26. The limb according to claim 22, wherein said stiffening elements are a set of lateral tension elements.

27. The limb according to claim 26, wherein said lateral tension elements are on the front of said limb.

28. The limb according to claim 26, wherein said lateral tension elements are on the rear of said limb.

29. The limb according to claim 22, wherein said stiffening elements are a set of lateral compressive elements.

30. A limb for an archery bow, wherein said limb comprises a means for storing energy by torsional and rotational deformation.

31. The limb according to claim 30, further comprising a means for increasing the torsional stiffness of said means for storing energy.

* * * * *

UNITED STATES PATENT AND TRADEMARK OFFICE

CERTIFICATE OF CORRECTION

PATENT NO. : 6,536,421 B1
DATED : March 25, 2003
INVENTOR(S) : David A. Jenkins

It is certified that error appears in the above-identified patent and that said Letters Patent is hereby corrected as shown below:

Column 1,
Line 9, “be stored in, the limbs” should read -- be stored in the limbs --.
Line 18, “as fill draw” should be -- as full draw --.
Line 63, “will always, results” should be -- will always result --.

Column 6,
Line 22, “bending of the said limbs” should be -- bending of said limbs --.

Signed and Sealed this

Ninth Day of September, 2003

JAMES E. ROGAN
*Director of the United States Patent and Trademark Office*